United States Patent [19]

Liu et al.

[11] Patent Number: 4,882,250

[45] Date of Patent: Nov. 21, 1989

[54] COPPER PHTHALOCYANINE PHOTORECEPTOR AND METHOD FOR PRODUCING THE SAME

[75] Inventors: Jonq-Min Liu; Tai-Jun Chen, both of Hsinchu; Lii-Chyuan Tsai, Kaohsiung; Li-Wen Pai, Changhwa, all of Taiwan

[73] Assignee: Industrial Technology Research Institute, Hsinchu, Taiwan

[21] Appl. No.: 222,774

[22] Filed: Jul. 22, 1988

[51] Int. Cl.[4] ..... G03G 5/14

[52] U.S. Cl. ..... 430/58; 430/59; 430/76; 430/78; 430/135

[58] Field of Search ..... 430/76, 78, 58, 59, 430/135

[56] References Cited

U.S. PATENT DOCUMENTS 4,452,740 6/1984 Pepoy ..... 540/137
4,622,170 11/1986 Wynne ..... 428/359 X

FOREIGN PATENT DOCUMENTS 56-00845 7/1981 Japan .
62-12784 6/1987 Japan .

*Primary Examiner*—J. David Welsh
*Attorney, Agent, or Firm*—Ladas & Parry

[57] ABSTRACT

A photoreceptor comprises a conductive substrate, a charge generating layer and a charge transporting layer, the charge generating layer being formed by bonding to the substrate a film layer having a composition consisting of copper phthalocyanine and a binder and then exposing said bonded film to iodine vapor for 1–120 min at 20 deg C.–90 deg C. The charge transporting layer is formed of a binder and an organic compound selected from hydrazones, pyrazolines, oxazoles, thiazoles and triaryl methane.

2 Claims, No Drawings

COPPER PHTHALOCYANINE PHOTORECEPTOR AND METHOD FOR PRODUCING THE SAME

BACKGROUND OF THE INVENTION

This invention relates to a photoreceptor used in electrophotographic machines such as photocopying machines, laser printers, facsimiles, etc., and particularly to an improved photoreceptor formed by exposing a copper phthalocyanine photoconductive film to iodine vapour.

The early photoconductive materials used as photosensitizers in electrophotography were generally inorganic materials such as selenium, cadmium sulphide, zinc oxide, etc. Since inorganic photoconductive materials were disadvantageous due to their high cost and the difficulties they caused in manufacturing, and their toxicity which pollutes the environment, they were gradually superseded by organic photoreceptors which are easy to manufacture, cheaper nontoxic and flexible.

Generally speaking, there are two types of organic photoreceptors: a single layer type and a separate function laminate. The single layer type organic photoreceptor is formed by bonding to a conductive substrate a photosensitive film having a composition consisting of a charge generating material, a charge transporting material and a binder. The separate function laminate comprises a conductive substrate on which a layer of charge generating material is formed by vapor deposition or applying with a brush, and a layer of charge transporting film applied on the charge generating layer. When an organic photoreceptor is illuminated, the charge generating material produces charge pairs, and by means of an electric field, electrons are transmitted through the conductive substrate. Holes are transmitted to the surface of the photoreceptor through the charge transporting material, neutralizing the negative charge on the surface and forming an electrostatic latent image.

Organic charge generating materials are photosensitive organic pigments such as bisazos, anthraquinones, thioindigoes, phthalocyanines. Copper phthalocyanine (Cu-Pc) is a blue-green pigment which has a strong coloring effect, excellent lightfastness, heat-resistance, chemical-resistance, and is inexpensive and nontoxic. Therefore it has been commonly used in the industry of photoreceptors.

There are eight forms of copper phthalocyanine crystals: such as $\alpha$-, $\beta$-, $\gamma$-, $\delta$-, $\pi$-, $\rho$-, $\chi$-, $\epsilon$-, among which $\alpha$-CuPc, $\beta$-CuPc, $\epsilon$-CuPc are the most popular pigments, and amoung which all have been massproduced. Particularly, $\epsilon$-Cu-Pc has a high degree of absorbing light in the region of 780 nm. This region is the wavelength of laser semiconductor. Since the electrophotographic image forming process in a laser printer or a facsimile utilizes the laser semiconductor as a light source, many attempts have been made to improve a charge generating material made from $\epsilon$-CuPc. However, $\epsilon$-CuPc has a drawback of being insufficiently photosensitive. Therefore, when $\epsilon$-CuPc is used as a photoreceptor, it can not produce a latent image of sufficient potential difference and thereby does not provide a clear development.

Japanese Pat. No. 55-161,249 discloses a process for enhancing the photosensitivity of $\epsilon$-CuPc by overlaying a sensitizing dye on the surface of $\epsilon$-CuPc. However, this process is disadvantageous because the wavelength of the light absorbed by $\epsilon$-CuPc is changed upon addition of the sensitizer, and $\epsilon$-CuPc has no sensitivity near the infra-red region (780 nm).

SUMMARY OF THE INVENTION

An object of the invention is to provide a copper phthalocyanine photoreceptor of high sensitivity which can be used to produce a clear image in an electronic photographic device such as a photocopying machine, a laser printing machine, or a facsimile.

Another object of the invention is to improve the photosensitivity of copper phthalocyanine photoreceptor by treating copper phthalocyanine with iodine after copper phthalocyanine is formed into a film.

The present invention provides a photoreceptor having a conductive substrate, a layer of charge generating material and a layer of charge transporting material. The charge generating layer is formed by bonding to the conductive substrate a film of the binder and copper phthalocyanine and then exposing the applied layer to iodine vapour for 1–120 min at a temperature of 20–90 degs C. in a closed container. Preferably, the charge generating layer contains 0.01–1% by weight of absorbed iodine per weight of copper phthalocyanine. If the time taken by the above absorption process is too short and/or the temperature of iodine vapour is too low, the amount of iodine absorbed will be less than 0.01% by weight per weight of copper phthalocyanine which has no effect on the enhancement of the photosensitivity of the charge generating layer. If the time taken is too long and/or the temperature of iodine vapour is too high, the amount of iodine absorbed will be too high, causing the surface of the charge generating layer to be unable to accept sufficient electrostatic charge.

The present invention provides a simple process for treating copper phthalocyanine photoreceptor with iodine vapour to enhance the photosensitivity thereof. The process does not affect the absorbability of copper phthalocyanine.

The charge transporting material is a hole transporting material selected from hydrazones, pyrazolines, oxazoles, thiazoles and triaryl methane.

The binder used in the present invention may be poly (vinyl butyral), poly (vinyl acetate), polyesters, polycarbonates, phenoxy resins, acrylic resins, polyacrylamides, polyamides, polyvinylpyridine, cellulosic resins, urethane resins, epoxy resins, casein, poly (vinyl alcohol), or the like.

The present invention will be described in detail in the following examples.

EXAMPLE 1

On a 0.2 mm×260 mm×80 mm piece of alluminium foil was applied an adhesive layer prepared from polyamide and methyl alcohol (7% solid content). The adhesive was applied by a known dipping process and was dried at 60 degs C. for 30 min. The weight of the film was about 1.0 g/sq.m.

0.22 gm of poly (vinyl butyral) was dissolved by 10 gm of cyclohexanone and blended with 0.22 gm of $\epsilon$-Cu-Pc (Halogen blue 66700 manufactured by BASF) in a micronizing mill by milling for one hour. The blended substance was applied as a charge generating layer on the adhesive layer by a dipping process and dried in an oven at 60 degs C. for 30 min. The resulting weight was 0.3 g/sq.m.

The charge generating layer bonded to the aluminum substrate was placed in a container to be put in contact with iodine vapour which was fed into the container at a predetermined rate. The temperature of the iodine was 35 degs C. After 15 min, the coated alluminum substrate was removed from the container and cooled to room tamperature. The amount of iodine absorbed was 0.75 mg/sq.m.

1.0 gm of ρ-diethylaminobenzaldehyde-N- -naphthyl-N-phenyl hydrazone was blended with 1.5 gm of styrene MMA copolymer dissolved by 8 gms of toluene, then applied on the iodine-treated charge generating layer and dried in an oven at 90 degs C. for 60 min. The thickness of the charge transporting layer was 16 μm.

The photoreceptor obtained in this example was placed in an electrostatic paper analyzer (Model EPA 8100 manufactured by Kawaguchi Denki Co., Ltd.) for testing. The photosensitivity of the photoreceptor was measured in terms of light energy required to reduce the potential energy of the surface to an amount equal to half of the original potential energy. When the light source was a halogen lamp, the light energy required was 5.4 lux. sec. When a 780 nm filter glass was used to create a wave length of 780±10 nm, the light energy required was 0.1 lux. sec.

EXAMPLE 2

The materials and the procedure used in this Example were substantially similar to that of Example 1 except that the container containing iodine vapour was a closed container and was saturated with iodine vapour whose temperature was 27.5 degs C., and the time taken for exposing the charge generating material to iodine was 60 mins. The amount of iodine absorbed in this example was 1 mg/sq.m. Test results show that the light energy required was 4.5 lux. sec when the light source was of full spectra and 0.1 lux. sec when the light source had a wave length of 780 nm.

COMPARATIVE EXAMPLE 1

The materials used and the procedure of this example were substantially similar to that of Example 1 except that the charge generating material was not treated with iodine.

The test results show that the energy required was 12.0 lux.sec when the light source was of full spectra and 0.3 lux. sec when the wave length is 780 nm.

From Examples 1 and 2 and the above comparative example, it can be seen that the photosensitivity of ε-CuPc photoreceptor is improved after it has been treated with iodine vapor,

EXAMPLE 3

The substrate used in this example was an aluminum drum of 30 mm in diameter and 260 mm in length. A polyamide adhesive with a solid content of 7% was prepared by dissolving polyamide with methyl alcohol and was applied on the substrate and dried at 60 degs C. for 30 min. The film weight was 1.0 g/sq.m.

6 gm of polyvinyl butryl was dissolved in 200 gm of cyclohexanone and was blended with 6 gm of ε-CuPc and 200 gm of butanone by milling for 72 hrs in a ball mill. The blended material was applied on the adhesive layer by dipping, and dried in an oven at a temperature 60 degs C. The charge generating film layer has a thickness of about 0.3 gm/sq.m.

The drum was placed in a closed container which was saturated with iodine vapour and kept at a temperature of 25 degs C. After 30 min, the drum was removed from the container, cooled to room temperature and then coated with a charge transporting layer whose composition consisted of 40 gm of p-diethylaminobenzoldehyde-N-αphenyl hydrazone, 60 gm of styrene-MMA copolymer and 330 gm of tolune.

After being applied with a charge transporting layer, the drum was oven-dried at 90 degs C. for 60 min. The resulting thickness of the charge transporting layer was about 20 μm.

The drum photoreceptor obtained from this example was placed in a laser printer ( Model LBP-8II manufactured by CANON COMPANY) for testing. The clear printed copy shown in FIG. 1 was obtained by using this drum photoreceptor.

COMPARATIVE EXAMPLE 2

The materials used and the procedure of this example were substantially similar to that of Example 3 except that the drum was not treated with iodine vapour. The drum photoreceptor obtained from this comparative example provided the poor copy shown in FIG. 2.

While the examples of photoreceptors described above are separate function laminates, a single layer photoreceptor may also be produced according to the process of the invention. That is to say, both the charge generating material and the charge transporting material can be blended together with a binder, then applied to a conductive film, and exposed to iodine vapor.

With the invention thus explained, it is apparent that numerous modifications and variations can be made without departing from the scope of the invention. It is intended that this invention be limited only as indicated in the appended claims.

What I claim is:

1. A photoreceptor have a substrate, a layer of charge generating material and a layer of charge transporting material, said charge generating layer being formed by applying a film forming composition comprising a binder and copper phthalocyanine, and then exposing said composition to iodine vapor at a temperature of 20–90 deg. C., said charge transporting material comprising a binder and a compound selected from hydrazones, pyrazolines, oxazoles, thiazoles and triaryl methane.

2. A process for making a copper phthalocyanine photoreceptor comprising:

applying an adhesive to a conductive substrate;

applying on said adhesive a charge generating layer having a composition comprising a film forming binder and copper phthalocyanine;

exposing said composition to iodine vapor at a temperature of 20–90 deg. C.; and applying on said charge generating layer a charge transporting layer having a composition comprising a binder and an organic compound selected from hydrazones, pyrazolines, oxazoles, thiazoles and triaryl methane.

* * * * *